US009920887B2

(12) United States Patent
Van Delden

(10) Patent No.: US 9,920,887 B2
(45) Date of Patent: Mar. 20, 2018

(54) INTERNAL ENVELOPE INFRASTRUCTURE FOR ELECTRICAL DEVICES

(71) Applicant: PHILIPS LIGHTING HOLDING B.V., Eindhoven (NL)

(72) Inventor: Martinus Hermanus Wilhelmus Maria Van Delden, Venlo (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/403,200

(22) PCT Filed: May 28, 2013

(86) PCT No.: PCT/IB2013/054412

§ 371 (c)(1),
(2) Date: Nov. 24, 2014

(87) PCT Pub. No.: WO2013/179227

PCT Pub. Date: Dec. 5, 2013

(65) Prior Publication Data

US 2015/0109770 A1 Apr. 23, 2015

Related U.S. Application Data

(60) Provisional application No. 61/728,288, filed on Nov. 20, 2012, provisional application No. 61/652,874, filed on May 30, 2012.

(30) Foreign Application Priority Data

May 29, 2012 (EP) ..... 12169724

(51) Int. Cl.
*F21K 9/23* (2016.01)
*F21K 99/00* (2016.01)
(Continued)

(52) U.S. Cl.
CPC ..... *F21K 9/175* (2013.01); *F21K 9/27* (2016.08); *F21K 9/90* (2013.01); *F21V 3/0427* (2013.01);
(Continued)

(58) Field of Classification Search
CPC . F21K 9/27; F21V 25/02; F21V 25/04; F21V 19/003; F21Y 2103/10
(Continued)

(56) References Cited

U.S. PATENT DOCUMENTS 6,409,361 B1 6/2002 Ikeda
6,582,103 B1 6/2003 Popovich et al.
(Continued)

FOREIGN PATENT DOCUMENTS

DE 102006017718 A1 5/2007

*Primary Examiner* — Christopher Raabe
(74) *Attorney, Agent, or Firm* — Akarsh P. Belagodu

(57) ABSTRACT

The invention relates to a housing (1) for an electrical device wherein an inner surface (2) of said housing has a conductive pattern (3) providing at least one conductive track, said track being arranged to provide local electric interconnection from the housing to at least one enclosed electrical component of said electrical device and/or vice versa, wherein the conductive pattern is fixedly fastened to said inner surface (2) of said housing so that said conductive pattern will break if the housing wall is broken where the conductive pattern is fastened.

20 Claims, 2 Drawing Sheets

(51) Int. Cl.

| | |
|---|---|
| ***F21V 3/04*** | (2018.01) |
| ***F21V 19/00*** | (2006.01) |
| ***F21V 25/02*** | (2006.01) |
| ***F21V 29/506*** | (2015.01) |
| ***F21V 29/70*** | (2015.01) |
| ***F21K 9/90*** | (2016.01) |
| ***F21V 23/06*** | (2006.01) |
| ***F21K 9/27*** | (2016.01) |
| *F21Y 103/10* | (2016.01) |
| *F21Y 115/10* | (2016.01) |

(52) U.S. Cl.
CPC ..... *F21V 3/0436* (2013.01); *F21V 19/003* (2013.01); *F21V 19/0085* (2013.01); *F21V 23/06* (2013.01); *F21V 25/02* (2013.01); *F21V 29/506* (2015.01); *F21V 29/70* (2015.01); *F21Y 2103/10* (2016.08); *F21Y 2115/10* (2016.08); *Y10T 29/4913* (2015.01)

(58) Field of Classification Search
USPC ..... 362/218
See application file for complete search history.

(56) References Cited

U.S. PATENT DOCUMENTS

| | | | | |
|---|---|---|---|---|
| 2004/0037079 | A1 | 2/2004 | Luk | |
| 2005/0162850 | A1* | 7/2005 | Luk et al. | 362/227 |
| 2009/0161359 | A1 | 6/2009 | Siemiet et al. | |
| 2011/0006684 | A1 | 1/2011 | Hodgson et al. | |
| 2011/0101842 | A1 | 5/2011 | Valenzano | |
| 2012/0069556 | A1* | 3/2012 | Bertram | F21V 23/02 362/217.14 |
| 2014/0091335 | A1* | 4/2014 | Satake | F21V 17/10 257/88 |

* cited by examiner

INTERNAL ENVELOPE INFRASTRUCTURE FOR ELECTRICAL DEVICES

CROSS-REFERENCE TO PRIOR APPLICATIONS

This application is the U.S. National Phase application under 35 U.S.C. § 371 of International Application No. PCT/IB13/054412, filed on May 28, 2013, which claims the benefit of U.S. Provisional Patent Application No. 61/728,288, filed on Nov. 20, 2012 and 61/652,874 filed on May 30, 2012 and European Patent Application No. 12169724.7 filed on May 29, 2012. These applications are hereby incorporated by reference herein.

FIELD OF THE INVENTION

The present invention relates generally to a housing for an electrical device. More particularly, the present invention relates to a housing as defined in the introductory parts of claim 1 and to an electrical device as defined in the introductory parts of claim 10. The invention further relates to a method for manufacturing such a housing or electrical device.

BACKGROUND OF THE INVENTION

An issue in electrical devices, especially in lighting devices, and in particular in fluorescent and LED based light tubes (TLED) is to get the device certified and approved for commercial use. Such certification is, e.g. issued by the independent product safety certification organization Underwriters Laboratories (UL). A lighting device that potentially provides a risk of human exposure to high voltage, e.g. mains supply voltage, has to be harmless even when the lighting envelope is broken, either in full or in part.

For vacuum-sealed glass-based fluorescent tubes such demands are easily met. When the glass envelope breaks, the high voltage (HV) discharge between the tube's electrodes, located at the outer ends, can no longer be sustained. Firstly, since the vacuum has disappeared and secondly because of the loss of mechanical support/separation/clamping of the electrodes to the power terminals.

For other electrical devices, e.g. TLED tubes, however, carrying end-to-end spanning electronics and mechanical support, safety approval, e.g. according to UL-standards, comes at substantial costs. Moreover, since many tube designs comprise plastic envelopes, there is a higher risk of potential high voltage exposure simply because shell fracturing does not inherently imply mechanical and/or electric failure as well. Thus, more expensive solutions must be deployed to meet electrical safety demands, e.g. UL demands. There is thus a need to provide a cheap solution to provide an electrically safe electrical device that is safe also when its housing is broken.

To cope with electrical demands in, e.g., TLED tubes several options exist in the field such as, for example, the deployment of larger, more costly and less efficient low-voltage LED drivers, in combination with low-voltage LED strings. Furthermore, since the driver's input terminals are connected to mains voltage, the driver must be isolated with a wrap and be housed in a casing. In some cases, the casing is an aluminium half-tube, providing sufficient driver protection as well as mechanical support, heat spreading and heat-sinking. But, it also adds substantial weight and costs when compared to a light weight, vacuum "filled" and inexpensive glass tube as used for fluorescent light tubes. The other tube half, which serves as a light exit window, consists of a plastic.

Another option is to deploy a smaller, cheaper and more efficient isolated high-voltage LED driver. The driver may additionally be isolated by means of a plastic housing of 1.6 mm thickness that is inserted into a tube end of a TLED. In this case, the high voltage LED string is carried by a somewhat more expensive PCB having a high voltage coating and a larger track-to-ambient spacing (1.6 mm) leading to a wider PCB, thus adding costs. The PCB is laminated with a high voltage insulating adhesive film onto a metal rail. The high voltage insulating adhesive film is expensive. The thin rail is made of extruded aluminium and provides a recessed cavity towards the PCBs thereby providing additional high voltage protection by means of access restriction. Besides that, the rail acts as a heat-spreader, heat-sink and mechanical bridge between the tube ends. In this case the tube's exterior comprises a full plastic (diffuse) tube.

As may be deduced from the above, the main functions of the expensive metal bridge when compared to "free" vacuum are to provide tube rigidity, resistance to bending/sagging and torque, mechanical support for PCBs and return tracks, heat-spreading and heat-sinking and in some cases also an optical cavity. Despite all of the above, the fact is that anything added in between the end-caps also adds weight and costs. Thus, the cheapest tube would be one without LEDs, the fluorescent tubes being the only choice available in the state of the art technology. On the other hand, a green tube should not hold mercury, should be more energy efficient and be more sustainable, i.e. be made of glass but comprising efficient light sources such as LEDs. All this has to be achieved at a low cost.

SUMMARY OF THE INVENTION

It is an object of the present invention to improve the current state of the art, to solve the above problems, and to provide an improved electrical device that minimizes the risk of human exposure to high voltage when the housing of the electrical device is broken. These and other objects are achieved by a housing for an electrical device wherein an inner surface of said housing has a conductive pattern providing at least one conductive track or area to form a local interconnection, said track or area being arranged to provide local electric contact from the housing to at least one enclosed electrical component of the electrical device and/or vice versa, wherein the conductive pattern is firmly attached, for example by physical adhesion or chemical bonding, to said inner surface of said housing so that said conductive pattern will break if the housing wall is broken at a location where the conductive pattern is attached. Thus, the pattern of tracks or areas is electrically floating if the enclosed electrical device is absent.

When the at least one enclosed electric component is present, an electrical connection is established by aligning electric contact points of the electrical component with the conductive area or track of the housing. The conductive track or area thus serves as a local electrical bridging for the electric current driving the electrical device. Consequently, without the complementary housing, the electrical device cannot be operated. By having part of an inner surface of the housing acting as part of the electrical connection for electrical components located inside the housing, the electrical connection of the electrical device will be interrupted and/or broken if the housing breaks. Similarly, a pattern may be set-up to comprise a set of two or more adjacent tracks allowing for the simultaneous interruption of e.g., both main terminals if the housing is broken. In that way, local interconnection provides a cheap solution to electrical safety regulations.

The conductive pattern on an inner surface of the housing may be made of an attached conductive film but is preferably a coating. If the conductive pattern is made from a film, the film is preferably thin, fragile and rigidly attached to the housing so that the film will break if the housing is broken. If the conductive pattern is a coating the conductive pattern will naturally break if the housing is broken.

The housing may further be transparent, and be made by any transparent material. For lighting devices the transparent material is preferably made of glass. Glass is a good material for the concept of this invention, since it is clear to anyone if the glass housing is broken or not. Advantageously, any coating present on the glass surface will be broken along with the glass. The housing may, however, also be made of plastic or other suitable materials. A clear polymer is then preferably used to make the housing transparent, if transparency of the housing is a feature required by the electrical device, as is the case for a lighting device.

The housing may further have a tubular shape, which is a housing shape where the present invention has especially large benefits. In tubular shaped housings for electrical devices, the electrical connection to the high voltage supply is often located in the end parts while the high voltage across the enclosed electrical components, e.g. a LED string, is often spread out along the tube length. The relatively large surface area and relatively long electrical distances from the electrical connection to this part of the electrical device makes it hard to meet the electrical safety standards. With the bridging conductive pattern on the inner wall of the housing, however, the relatively long electric path is divided into a large number of smaller sections. If the housing is intact, the smaller sections are connected towards each other by means of local bridges and a relatively high high-voltage will be present across the electrical components of the electrical device, e.g., across a LED string. When the housing is broken the connection between the smaller sections is interrupted. Similarly, the mains terminals of the net may be connected to a LED driver and in turn a LED driver to LED string(s).

The conductive track of the housing is preferably made of at least one material contained in the group consisting of: chromium, copper, silver, gold, aluminium, tin, titanium or a conductive composite or paste. The choice depends on the intended use of the housing, the requirements of conduction, material prices etc.

According to a further aspect of the invention, said conductive track(s) may also be arranged to assist in heat-sinking for the enclosed electrical device. By having a large surface area at the enclosed electric device to spread the heat generated at, e.g., the LEDs over a large surface area, heat sinking towards the ambient air may be assisted in aligning this area with a similar sized surface area at the conductive track on the inside of the housing. The conductive pattern on the inside of the housing wall has a good thermal connection with the environment outside the housing. For optimal heat-sinking between the two large surface areas, the air film in between the two surfaces is thus preferably small. In that way the conductive pattern of the housing may also assist in heat sinking to the electrical device, which is a feature often required for electrical devices encased in housings.

The electrical device comprised in a housing as described above preferably has at least one of the electric terminals towards the enclosed electric devices routed and electrically connected via a bridging interconnection using said local conductive track.

The electrical device may further comprise a light source, e.g., one or several LED units. The housing according to the invention is especially well suited for providing electrical safety to LED tubes used to replace fluorescent light tubes. The tube is then preferably made of glass having the conductive pattern coated on the inside of the glass.

If the electrical device has a light source it may further use the conductive track(s) to provide optical functions for said light source. The conductive coating may be made to have a high reflectance, which is fairly easy to achieve if the conductive coating is a metal coating. The conductive pattern may then be used as a reflector for the light source, the reflector having the shape of the housing on which it is coated.

According to one aspect of the present invention the electrical components of the electrical device are arranged on a sheet and inserted as a roll in said tube shaped housing. This is an especially useful solution if the housing has a tubular shape. If the electrical device comprises a LED-string the string may be printed as a string on the sheet intended to extend in the longitudinal direction of the tube. The remaining parts of the sheets are rolled into a tubular shape and inserted into the tube. The spring force of the tubular shaped roll towards the tube inner surfaces will press the sheet towards the housing walls, thereby also minimizing the air gap between the heat spreader at the sheet and the heat-sink at the glass tube. The sheet carrying the LED string is equipped with electrical connections on the backside of the sheet, e.g., by folding one of the sheet edges carrying the contacts. The electric contacts are next aligned with the conductive pattern on the housing to facilitate electric routing of one or more electrical terminals needed for driving the LEDs in the LED-string. If the tube housing is broken, the electrical terminals are no longer routed by said tracks on the broken housing and potential electrical hazards are minimized.

The invention further relates to a method of producing a housing for an electrical device comprising the step of: coating an inner surface of said housing with a conductive pattern providing at least one conductive track, wherein said track is arranged to provide a local electric interconnection from the housing to one or more enclosed electrical components of the electrical device and back, or vice versa, i.e. from the electrical components of the electrical device to the housing and back. The method of coating may comprise a method in the group of: spray coating, roll coating, dip coating, selective coating by surface wetting, (ink) pad coating, stamping, embossing, and rolling. The skilled person understands that any method for providing a patterned conductive coating to the inner surface of the housing may be used as long as the feature is achieved to provide a coating that breaks along with the housing if the housing is broken.

Consequently, as the mechanical envelope breaks the electric infrastructure collapses simultaneously. Hence, there is no need for additional high-voltage insulation measures, such as high voltage insulating tapes/adhesive, wider PCBs, recessed (LEDs) contacts, less efficient low voltage drivers, etc.

It is noted that the invention relates to all possible combinations of features recited in the claims.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
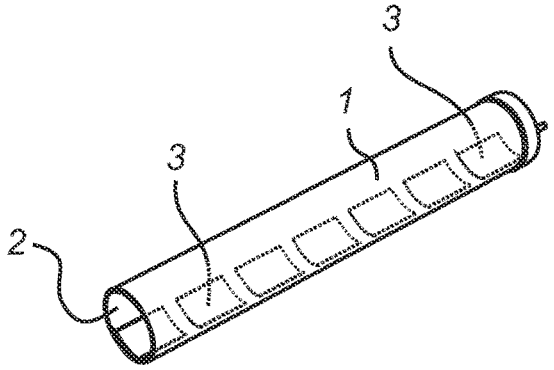
FIG. 1*a* is a perspective view of the housing according to the present invention having a coated conductive pattern on the inside of the housing wall.

FIG. 1*a* shows one embodiment of a housing 1 according to the present invention. The housing has a coated conductive pattern 3 on the inside of the housing wall 2. The coated conductive pattern 3 is designed to provide the missing pieces or electrical bridging to an electrical device that is inserted into the housing. The conductive pattern 3 alone thus does not provide a continuous electrical interconnection but comprises a pattern of electrically separated or isolated electrical tracks or bridges. The housing 1 in FIG. 1*a* is intended as a lighting device and the tube is therefore made of a transparent material, preferably glass or a clear plastic material.

Figure 1B:
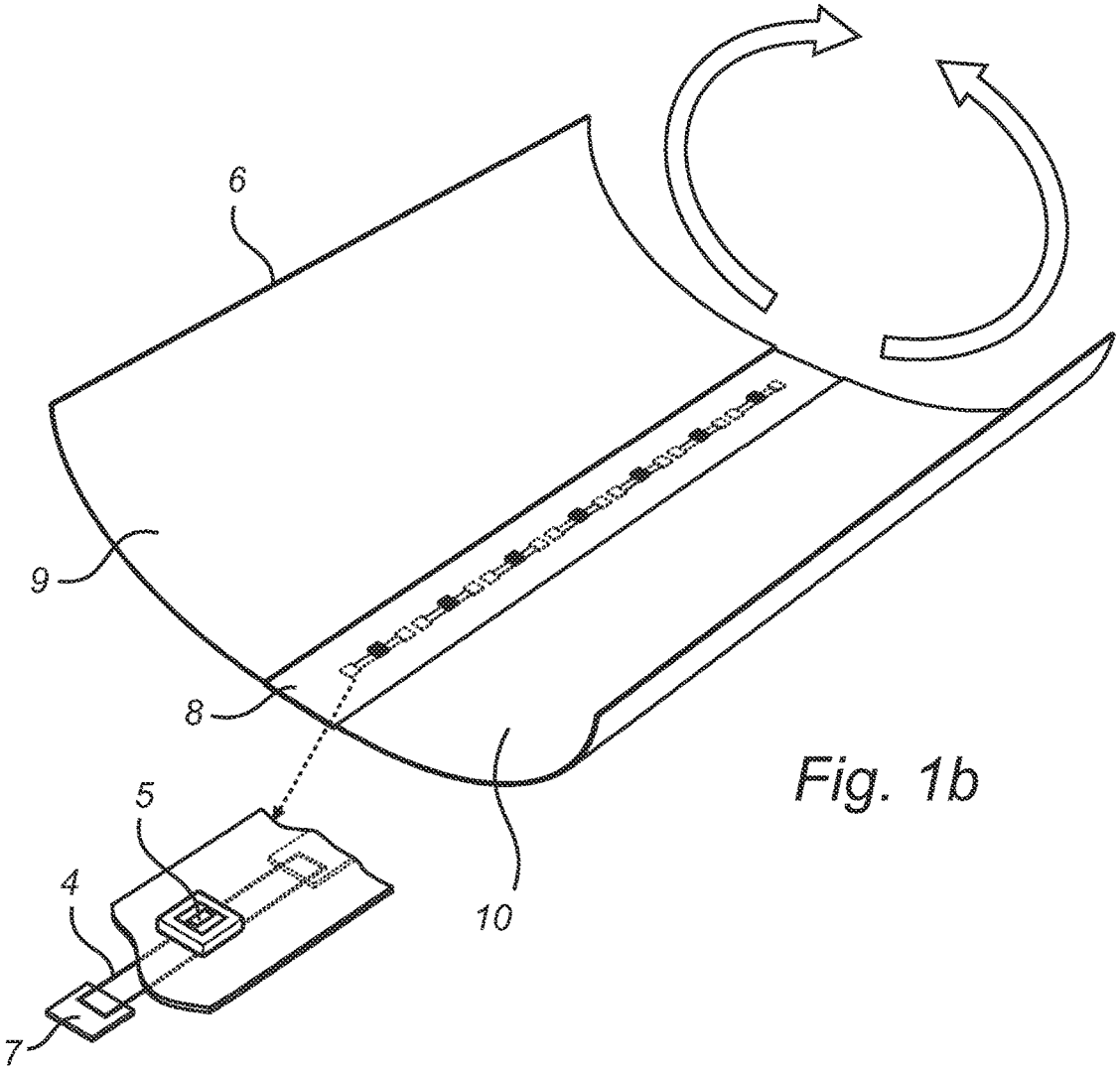
FIG. 1*b* is a perspective view of one embodiment of the LED-device adapted to be fitted in the housing shown in FIG. 1*a*.

FIG. 1*b* shows one embodiment of a LED-device adapted to be fitted in the housing 1 shown in FIG. 1*a*. The LED-device is formed on a carrier sheet 6, wherein the sheet has a series of isolated LEDs disposed as a string 8 along its longitudinal direction. This sheet is intended to be fitted inside and along the longitudinal direction of the housing 1. A number of LEDs 5 are placed as electrically isolated units along the LED-string 8. Electrical terminals 4 provide each LED 5 in the LED string 8 with two electric contacts 7 located on the backside of the sheet, which is the side opposite to a side of the sheet 6 where the LED string 8 is placed. Alternatively, the electrical terminals of the LEDs 5 may be located on the same side of the sheet 6 as on which the LEDs 5 are provided. The electrical contacts 4 establish the electrical contact between the neighbouring LEDs by means of the conductive tracks or bridges 3 at the inside surface of the tube housing 1 in FIG. 1*a*. In order to establish a properly functioning electrical connection the pattern of bridges 3 and electric contacts 4 have to be aligned with respect to each other. Thus by electrically interconnecting the conductive pattern 3, which comprises a pattern of electrically separated or isolated conductive tracks or bridges, with the series of isolated LEDs a continuous electrical circuit is created comprising the series of LEDs electrically interconnected via the pattern of electrically separated or isolated conductive tracks or bridges.

Figure 2:
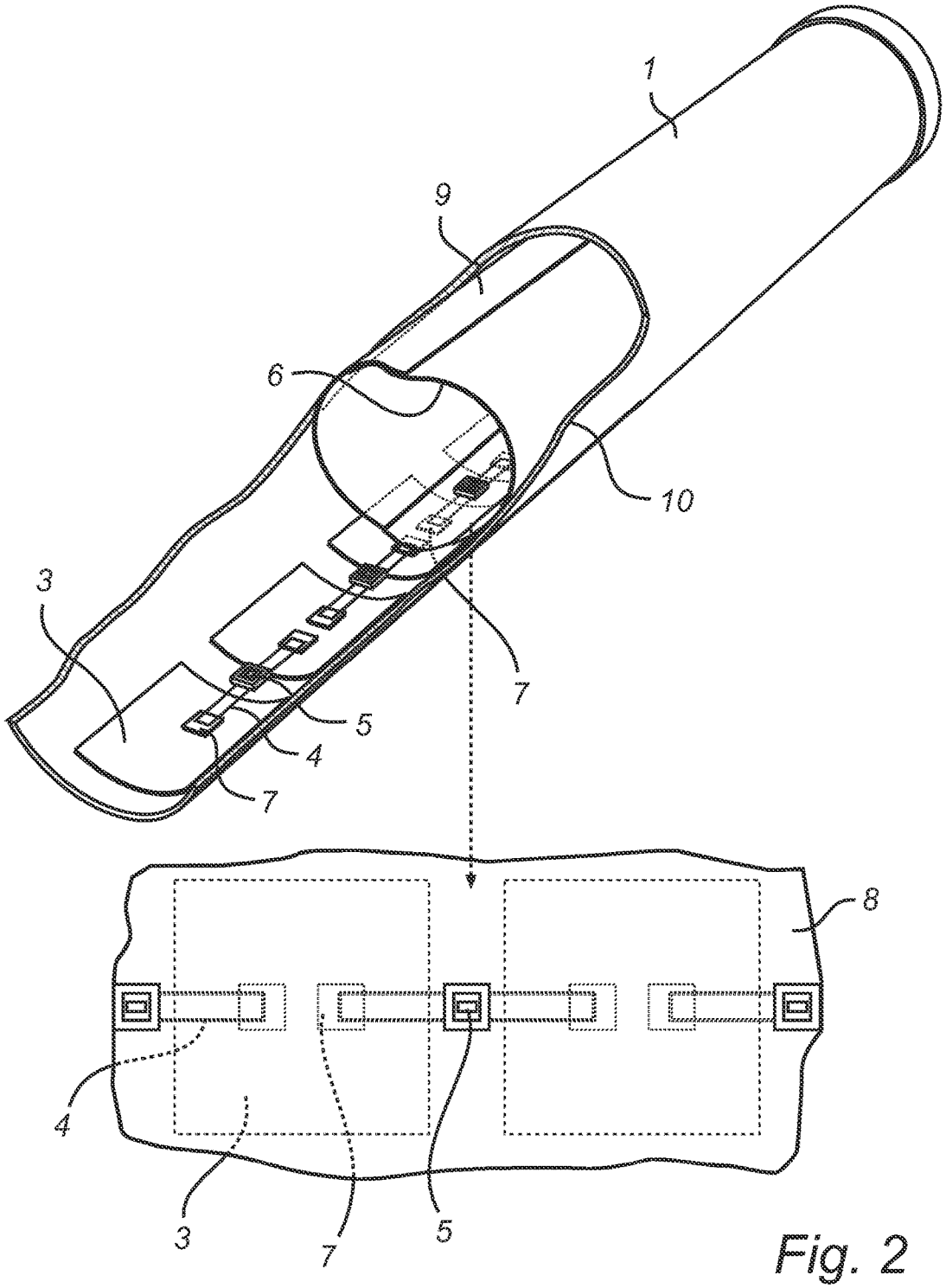
FIG. 2 is a perspective view of the LED device of FIG. 1*b* in the housing of FIG. 1*a*, where the bridging interconnection between the housing and the LED-device can be seen.

The side parts 9, 10 are provided to enable the insertion of the LED-string as a roll into the housing 1 and to provide a spring force that presses the contacts 4 against the bridges 3 at the inner housing wall in FIG. 1*a*. The roll is rolled into a, in this case, tubular shape that fits and abuts a large part of the inner wall of the housing 1. One or both side parts 9, 10 may also be made of a transparent or diffuse material, e.g., a plastic foil. Alternatively, the tube may be made diffuse. Thus, light from the LEDs may leave the tube through the transparent housing. The LED-string 8 may be placed at any lateral position on the sheet 6 so that the parts 9, 10 may have different sizes and/or properties. If the LED-string 8 is placed at the outer edges of the sheet 6 one of the side parts 9, 10 may be omitted. One of the sides 9, 10, may also be made of a diffuse reflecting material. Combined with a diffuse part 9, 10 or a diffuse glass tube and a clear part 9, 10 a diffuse recycling optical cavity may be formed when the roll is inserted into the housing 1. FIG. 2 shows the LED device of FIG. 1*b* in the housing 1 of FIG. 1*a*, where the bridging interconnection 3 between the housing and the LED-device can be seen. The terminals 4 end at the contacts 7 at the backside of the sheet 6 and are in aligned electric contact with the coated conductive pattern 3 on the inside of the housing 1, thereby interconnecting the electrically isolated LEDs unit 5 of the LED string 8 as one electric device which can be powered by connecting the conductive pattern 3 that is electrically connected to the LED string 8 to a current or voltage source. As is seen in FIG. 2, this requires that the LED-string is correctly aligned inside the housing 1. The sheet 6 preferably has a size that fills the entire length of the housing and a design of the LED-string so that the alignment between the housing and the LED device is automatically achieved.

If the housing 1 is broken, part of the housing and the coating 3 will disappear along some section of the housing 1 and thus also lose its corresponding electrical connection 7 of a LED 5 of the LED-string 8 with the result that the electrical connection is lost for all LEDs. In addition, due to the expanding roll diameter, resulting in warp, other bridging connections will also be interrupted such as those of the driver to mains power supply and driver to the LED string 8. Further, a glass tube can very easily be engineered to break in many (large or small sized) fragments. A broken device will accordingly stop working and therefore provide a reduced electrical hazard.

Compared to previous solutions, the above described embodiment thus eliminates a large part of the cost issues associated with electrical safety regulations by deploying a traditional glass envelope in combination with LED based light engines without compromising on electrical safety, driver isolation, costs, energy usage, optical appearance, system efficacy and manufacturing.

The skilled person understands that the principle shown in the described embodiment above is easily adjusted to also provide two or more conductive patterns or conductive tracks to facilitate the same safety feature for both of the power terminals of the electrical device, in this case a LED device. It is further understood that the electrical connection between the LEDs may be in series or in parallel while using at least one or more electrical terminals with interconnection to the housing's conductive pattern.

It is understood that other variations in the present invention are contemplated, and in some instances, some features of the invention can be employed without a corresponding use of other features. Accordingly, it is appropriate that the appended claims be construed broadly in a manner consistent with the scope of the invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An electrical device comprising:

a tubular shaped housing wherein a conductive pattern, comprising at least one conductive track, is attached on an inner surface of the tubular shaped housing;

a sheet arranged in the tubular shaped housing as a roll; and at least one light source comprising electrical terminals and arranged on the sheet and enclosed in the tubular shaped housing, wherein the conductive pattern is a discontinuous coating and the electric terminals of the at least one light source are electrically connected to the conductive pattern of the housing, thereby providing an electric routing for driving the at least one light source, wherein said conductive track provides a local electric bridging interconnection between the housing and the at least one light source and wherein the conductive pattern is structured such that breakage of the housing causes breakage of the conductive pattern.

2. The electrical device according to claim 1, wherein the sheet provides a spring force that presses the electrical terminals against the conductive pattern.

3. The electrical device according to claim 1, wherein the electric terminals are provided on a side of the sheet that is opposite to a side of the sheet where the at least one light source is provided.

4. The electrical device according to claim 1, wherein the at least one conductive track is a plurality of conductive tracks that are respectively disposed on the inner surface of the tubular shaped housing and wherein each conductive track of the plurality of conductive tracks is electrically isolated from each other conductive track of the plurality of conductive tracks.

5. The electrical device according to claim 4, wherein the at least one light source comprises a series of isolated light sources, each of the isolated light sources including respective electric terminals, and wherein the electric terminals of the series of light sources are aligned with and in contact with the plurality of electrically isolated conductive tracks, which form the electric routing for driving the series of light sources.

6. The electrical device according to claim 1, wherein the sheet is made of a transparent or diffuse material.

7. The electrical device according to claim 1, wherein the housing is transparent.

8. The electrical device according to claim 1, wherein the housing is made of glass.

9. The electrical device according to claim 1, wherein the housing is made of plastic.

10. The electrical device according to claim 1, wherein said conductive track is made of at least one material selected from the group consisting of: chromium, copper, silver, gold, aluminum, or a conductive composite or paste.

11. The electrical device according to claim 1, wherein said at least one conductive track(s) is arranged to provide at least one of heat-spreading or heat-sinking for said light source.

12. The electrical device according to claim 1, wherein the at least one light source is at least one LED-unit.

13. The electrical device according to claim 1, wherein the at least one light source is configured as an electrical bridge for at least one downstream light source such that any loss of electrical connection to the conductive track by the at least one light source induces a loss of power to the at least one downstream light source.

14. The electrical device according to claim 13, wherein the at least one conductive track is a plurality of conductive tracks, wherein each of the conductive tracks is electrically isolated from each other conductive track of the plurality of conductive tracks in said conducive pattern, wherein a first electric terminal of the electric terminals is directly coupled to a first track of the plurality of conductive tracks, wherein a second electric terminal of the electric terminals is directly coupled to a second track of the plurality of conductive tracks, and wherein the at least one downstream light source includes a third electric terminal that is distinct from said first and second electric terminals and is directly coupled to said second track.

15. A method for producing an electrical device comprising a housing for at least one light source comprising the steps of:

discontinuously coating an inner surface of said housing with a conductive pattern coating providing at least one conductive track, wherein said conductive track is arranged to provide a local electric bridging interconnection between the housing and said light source, wherein the conductive pattern is structured such that breakage of the housing causes breakage of the conductive pattern;

providing the at least one light source on a sheet; and inserting the sheet as a roll in said tubular shaped housing such that electric terminals of the at least one light source are electrically connected to the conductive pattern coating, thereby providing an electric routing for driving the at least one light source.

16. The method according to claim 15, wherein the at least one light source is configured as an electrical bridge for at least one downstream light source such that any loss of electrical connection to the conductive track by the at least one light source induces a loss of power to the at least one downstream light source.

17. An electrical device comprising:

a tubular shaped housing wherein a conductive pattern, comprising at least one conductive track, is attached on an inner surface of the tubular shaped housing;

a sheet arranged in the tubular shaped housing as a roll; and at least one light source comprising electrical terminals and arranged on the sheet and enclosed in the tubular shaped housing, wherein the conductive pattern is a discontinuous coating and the electric terminals of the at least one light source are electrically connected to the conductive pattern of the housing, thereby providing an electric routing for driving the at least one light source, wherein said conductive track provides a local electric bridging interconnection between the housing and the at least one light source, wherein a surface area of a side of said conductive track that provides the interconnection is larger than a light emitting surface area of said at least one light source, and wherein the conductive pattern is structured such that breakage of the housing causes breakage of the conductive pattern.

18. The electrical device according to claim 17, wherein the at least one light source is configured as an electrical bridge for at least one downstream light source such that any loss of electrical connection to the conductive track by the at least one light source induces a loss of power to the at least one downstream light source.

19. The electrical device according to claim 18, wherein the at least one conductive track is a plurality of conductive tracks, wherein each of the conductive tracks is electrically isolated from each other conductive track of the plurality of conductive tracks in said conducive pattern, wherein a first electric terminal of the electric terminals is directly coupled to a first track of the plurality of conductive tracks, wherein a second electric terminal of the electric terminals is directly coupled to a second track of the plurality of conductive tracks, and wherein the at least one downstream light source includes a third electric terminal that is distinct from said first and second electric terminals and is directly coupled to said second track.

20. The method according to claim 16, wherein the at least one conductive track is a plurality of conductive tracks, wherein each of the conductive tracks is electrically isolated from each other conductive track of the plurality of conductive tracks in said conducive pattern, wherein a first electric terminal of the electric terminals is directly coupled to a first track of the plurality of conductive tracks, wherein a second electric terminal of the electric terminals is directly coupled to a second track of the plurality of conductive tracks, and wherein the at least one downstream light source includes a third electric terminal that is distinct from said first and second electric terminals and is directly coupled to said second track.

* * * * *